US005888007A

United States Patent [19]

Nicoll et al.

[11] Patent Number: 5,888,007

[45] Date of Patent: Mar. 30, 1999

[54] MARKING INSTRUMENT

[75] Inventors: Roy Nicoll; Mark Arthur Seddon, both of Berkshire, United Kingdom

[73] Assignee: The Gillette Company, Boston, Mass.

[21] Appl. No.: 849,154

[22] PCT Filed: Nov. 8, 1995

[86] PCT No.: PCT/US95/14538

§ 371 Date: Jul. 30, 1997

§ 102(e) Date: Jul. 30, 1997

[87] PCT Pub. No.: WO96/14998

PCT Pub. Date: May 23, 1996

[30] Foreign Application Priority Data

Nov. 14, 1994 [GB] United Kingdom ..... 9422906

[51] Int. Cl.[6] ..... B43K 5/08

[52] U.S. Cl. ..... 401/206; 401/148; 401/151

[58] Field of Search ..... 401/206, 205, 401/148, 151, 230, 13

[56] References Cited

U.S. PATENT DOCUMENTS

| | | | |
|---|---|---|---|
| 1,181,574 | 5/1916 | Crocker | 401/157 |
| 1,580,093 | 4/1926 | Upton . | |
| 1,607,048 | 11/1926 | Bergquist . | |
| 1,839,160 | 12/1931 | Nissen, Jr. . | |
| 1,875,184 | 8/1932 | Steigleder . | |
| 2,113,695 | 4/1938 | Krannak . | |
| 2,129,186 | 9/1938 | Sturm et al. . | |
| 2,376,222 | 5/1945 | Barlow . | |
| 2,502,866 | 4/1950 | Lust . | |
| 2,644,613 | 7/1953 | Pepin | 222/103 |
| 2,652,032 | 9/1953 | Lipic . | |
| 2,804,846 | 9/1957 | Rogers | 401/186 |
| 2,985,906 | 5/1961 | Reimann . | |
| 2,996,750 | 8/1961 | Cholet | 401/206 |
| 3,223,289 | 12/1965 | Bouet | 222/209 |
| 3,233,275 | 2/1966 | Hansen et al. | 401/275 |
| 3,374,928 | 3/1968 | Hope | 222/105 |
| 3,407,968 | 10/1968 | Fiquet et al. | 222/104 |
| 3,589,824 | 6/1971 | Andrews et al. | 401/206 X |
| 3,640,631 | 2/1972 | Sotir | 401/206 |
| 3,724,722 | 4/1973 | Ballo | 222/105 |
| 3,792,932 | 2/1974 | Henriksen | 401/205 X |
| 4,522,063 | 6/1985 | Bronson . | |
| 4,572,691 | 2/1986 | Kirchhoff et al. | 401/214 |
| 4,573,820 | 3/1986 | Kirchhoff | 401/214 |
| 4,812,071 | 3/1989 | Batra | 401/264 |
| 4,813,463 | 3/1989 | Lin | 141/351 |
| 4,940,350 | 7/1990 | Kim | 401/209 |
| 5,005,737 | 4/1991 | Rohr | 222/212 |
| 5,007,756 | 4/1991 | Wey | 401/195 |
| 5,030,026 | 7/1991 | Chen | 401/209 |
| 5,051,017 | 9/1991 | Yorks | 401/209 |
| 5,056,949 | 10/1991 | Petrillo | 401/214 |
| 5,150,979 | 9/1992 | Gallagher | 401/209 |
| 5,180,242 | 1/1993 | De Laforcade | 401/132 |
| 5,240,152 | 8/1993 | Scholz | 222/336 |
| 5,248,063 | 9/1993 | Abbott | 222/95 |
| 5,249,875 | 10/1993 | Hori et al. | 401/148 |
| 5,332,326 | 7/1994 | Hori | 401/148 |

FOREIGN PATENT DOCUMENTS

| | | | |
|---|---|---|---|
| 0476492 | 9/1991 | European Pat. Off. . | |
| 0556440 | 7/1992 | European Pat. Off. . | |
| 0 554 099 A1 | 8/1993 | European Pat. Off. | B65D 83/00 |
| 926054 | 4/1955 | Germany | 401/148 |
| 2170697 | 2/1985 | United Kingdom . | |
| 9305966 | 4/1993 | WIPO . | |

*Primary Examiner*—Robert M. Fetsuga
*Assistant Examiner*—Kathleen J. Prunner
*Attorney, Agent, or Firm*—Chester Cekala; David A. Howley

[57] ABSTRACT

A marking instrument, such as a reservoir pen, has a valve for controlling communication between a reservoir chamber and a feed channel extending through a feed member to a marking tip. The feed member is retractable to open the valve when the tip is pressed against a surface. A subchamber is confined by a diaphragm sealingly connected between the feed member and the barrel, and when the marking tip is lifted from the surface, the diaphragm pushes the feed member forwardly so that the valve closes, after which the volume of the subchamber increases so that the ink is drawn through the channel from the tip.

8 Claims, 2 Drawing Sheets

MARKING INSTRUMENT

This invention relates to marking instruments such as writing instruments of the highlighter pen, felt tip pen, fiber tip pen, ballpoint pen and other types wherein a marking fluid is delivered to a marking tip from a reservoir chamber. The invention is particularly concerned with such marking instruments wherein means are provided to pressurize the marking fluid in the reservoir chamber to cause the fluid to flow to the marking tip when it is required. In WO 93/05966 for example there is described a marking instrument wherein the reservoir chamber is partially delimited by a diaphragm, and a member carrying the marking tip is adapted to retract into the barrel of the instrument when the tip is applied against a surface so that the diaphragm is deflected to pressurize the contents of the fluid reservoir. The diaphragm also serves as a valve member to isolate the interior of the reservoir chamber from a duct through which the fluid is supplied to the tip when the force against the tip is removed and it returns to a forward most position. It has been found that under some circumstances, the marking fluid can continue to flow or ooze to the marking tip, especially if the fluid is of a more viscous formulation, when the forces against the tip due to it being pressed against a surface are released, and this has been observed even where a valve is included to close the communication between the reservoir chamber and the marking tip.

The present invention has for its aim to provide a solution to the problem explained above and accordingly the invention provides a marking instrument comprising a reservoir chamber for holding a supply of marking fluid, a marking tip for applying the marking fluid to a surface, a fluid supply channel for conducting fluid to the tip, normally closed valve means controlling communication between the reservoir chamber and the supply channel, the marking tip being retractable to open the valve by pressing the tip against the surface, and means arranged to draw fluid through the supply channel from the tip during forward displacement of the tip after the valve means has closed.

Conveniently a subchaser of variable. volume is connected to the supply channel, the volume of the chamber being arranged to increase during forward displacement of the tip after the valve means has closed. In a preferred construction the subchamber is an auxiliary reservoir for the marking fluid and is partially confined by a resiliently deformable member which also acts to urge the marking tip to its forwardmost position. The fluid supply channel is formed in a feed member axially slidable in a barrel of the instrument in which the reservoir chamber is enclosed, and the resiliently deformable member is annular and sealingly connected between the feed member and the barrel. By this construction the resilient member is operable, upon opening of the valve means to pressurize the fluid in the main reservoir chamber to effect positive delivery of the fluid to the marking tip. Furthermore, to simplify further the construction and assembly, the resilient member can define a valve seat of the valve means. Thus, in the preferred embodiment, which is described in-greater detail below with reference to the drawings, the resiliently deformable member comprises a first collar sealingly attached to the feed member, a second collar sealingly connected to the barrel and forming a valve seat, and an annular deformable diaphragm section interconnecting the first and second collars. The precise form of the valve means is not crucial and it may be of any convenient type, such as a flap valve, or ball valve, having a valve member arranged to be lifted from its seat by retraction of the feed member and possibly urged to a closing position by spring means. The volume of the subchamber or auxiliary chamber need not be very large as fluid is supplied from the main reservoir chamber to satisfy the demand at the marking tip when the valve is opened. However, because the volume of the subchamber increases after the valve is closed, a negative pressure is created and acts to draw fluid back from the tip during the final part of the forward displacement of the tip. As the negative-pressure is generated only during a last part of the tip movement, the suction forces are not so great that air will be sucked into the reservoir system, which might interfere with smooth reliable supply of fluid when next needed.

A more complete understanding of the invention will be gained from the following detailed description of a particular embodiment, reference being made to the accompanying drawings, in which.

Figure 1:
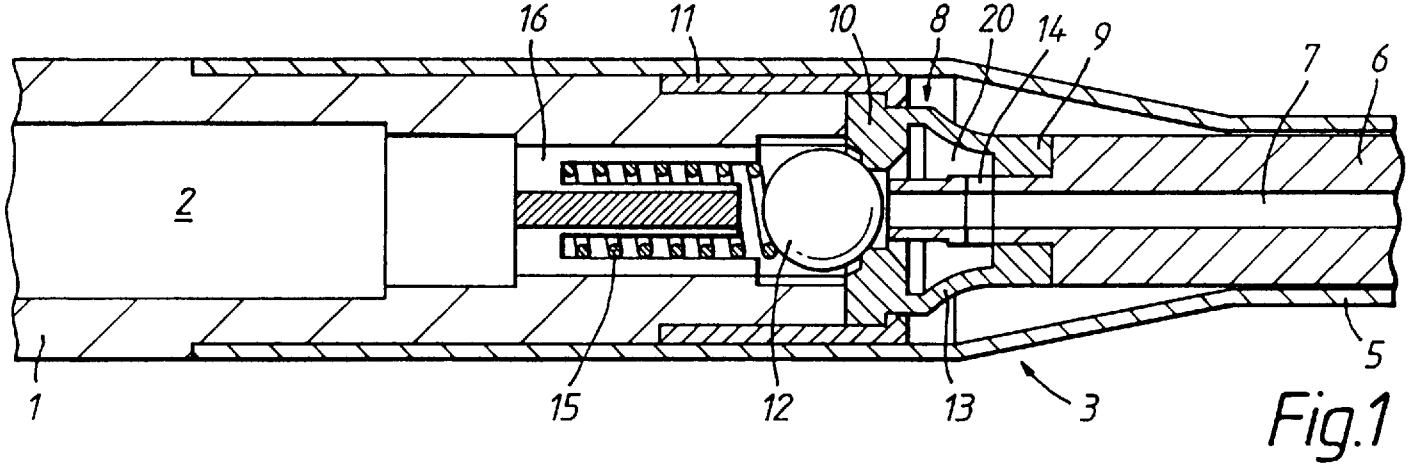
FIG. 1 is a partial axial cross-section through a marking instrument according to the invention, the components being illustrated in a normal position when there is no force applied against the marking tip.

The illustrated marking instrument, e.g. a reservoir pen, has a barrel including a body 1 enclosing a main reservoir chamber 2 for storage of a volume of marking fluid, i.e. ink in the case of a pen. The reservoir chamber is of such a kind that its internal volume decreases as the ink is used up. For this purpose the rear end of the chamber can be closed by an ink follower, such as a grease plug, which moves along the chamber to follow the ink column contained in the chamber as the ink is consumed. In this way it is unnecessary to supply air to the chamber to take up the space vacated by ink as it is used. Of course other forms of reservoir chamber, such as a collapsible flaccid sack are also possible. Fitted to the forward end of the body is a barrel nose 3 having a tapering cone portion leading to a cylindrical forward section 5. Axially slidable in the nose section 5 is a feed member 6 consisting of a cylindrical rod or bar with an axial bore 7 forming an ink supply channel for conducting ink to a marking tip 22 carried at the forward end of the feed member. The marking tip's particular type forms no part of this invention. The tip can be, for example, a felt tip, a fiber tip, ball point, roller ball, tubular nib or any other tip commonly used in marking instruments equipped with liquid reservoirs. At its trailing end the feed member 6 has a portion of reduced external diameter and seated against the annular shoulder defined on the feed member is a forward or inner collar 9 of a resiliently deformable member of which in the illustrated embodiment takes the form of a bellows-like diaphragm member 8. This diaphragm member includes a rear outer collar 10 which is sealed to the barrel and is hold clamped against the forward end of the body 1 by a sleeve 11 inserted between the body 1 and the nose 3. The inner edge of the collar 10 has a radius greater than that of the trailing end portion of the feed member and defines a valve seat for cooperation with a valve member in the form of a ball 12. The combination of valve seat and valve member constitute a normally closed valve means which controls communication between the reservoir chamber 2 and the ink supply channel 7. Extending between the collars 9, 10 of the diaphragm member is a resilient, deformable, rearwardly divergent bellows portion 13. The resilience of the diaphragm member 8 acts to urge the feed member 6, and hence the writing tip, to a forwardmost position and when in this position the diaphragm member encloses, with the trailing end of the feed member and the valve ball 12, a small volume subchamber 20 which communicates with the ink feed channel 7 through radial ports 14 in the feed member. The valve ball 12 is biased forwardly into sealing engagement with the seat by a coil spring 15 which is supported by a spring support 16 of cruciform cross-section having slots in the wings thereof to accommodate the spring.

Figure 2:
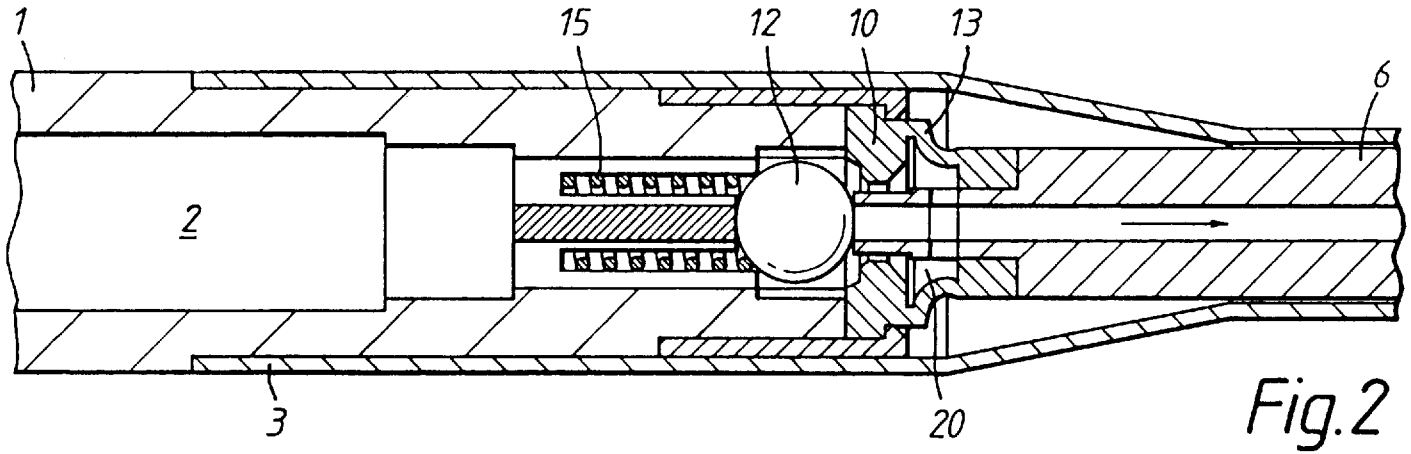
FIG. 2 shows the marking instrument of FIG. 1 when the marking tip in being pressed against a surface in preparation for laying down a trace of marking liquid.
Figure 3:
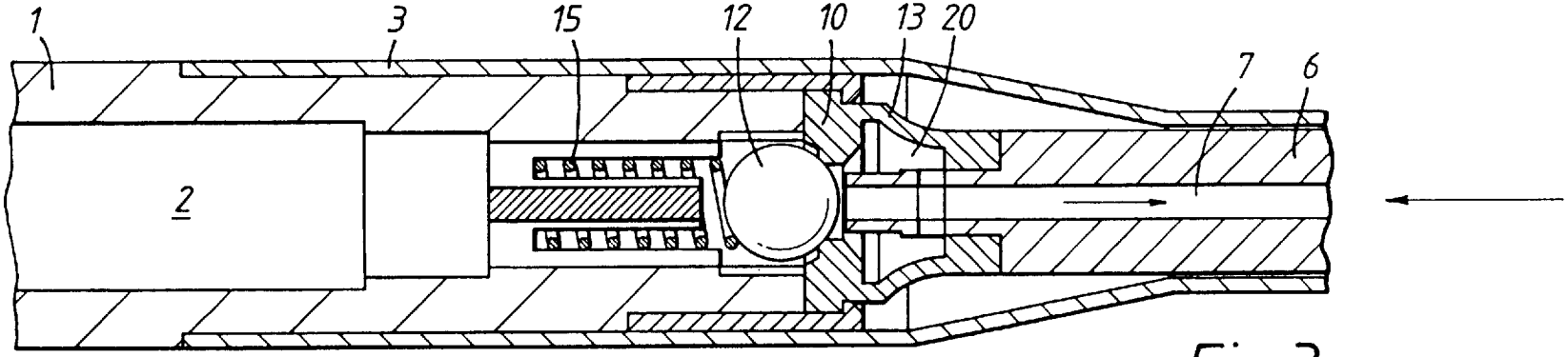
FIG. 3 shows the instrument of FIGS. 1 and 2 when the tip of the instrument is being lifted from the surface.

In the normal rest condition illustrated in FIG. 1, the trailing end of the feed member is spaced at a small distance from the valve ball which is held in sealing engagement with the valve seat thereby isolating the main reservoir chamber 2 from the subchamber 20 and the feed channel 7. Upon applying the writing tip against a surface 24 under normal writing pressure, the feed bar 6 retracts into the barrel and its trailing end first takes up the clearance between the feed member and the valve ball. This initial retraction causes the bellows portion to reduce the volume of the subchamber to pressurize the liquid contained in the subchamber to displace the liquid into the supply channel for delivery to the writing tip. Upon further retraction the feed member lifts the ball away from its seat against the bias of the spring 15, whereby communication between the main reservoir chamber 2 and the subchamber is established. As the retraction of the feed member continues the bellows portion 13 of the diaphragm member collapses inwardly further reducing the volume of the subchamber 20 and pressurizing the ink contained in the reservoir system to force the ink to flow through the feed channel 7 to the writing tip. This is the condition illustrated in FIG. 2. When the writing tip is subsequently lifted from the surface, e.g. at the end of writing a word, the diaphragm member 8 urges the feed member 6 forwardly and its bellows portion 13 expands again. The resulting increases in volume of the subchamber 20 is initially satisfied by ink passing from the main reservoir chamber 2 through the still open valve. Upon the valve closing however, a small amount of the forward stroke of the feed member still remains, and the increase in volume of the subchamber which occurs during this part of the stroke results in a negative pressure being created in this space 20 tending to draw ink back through the supply channel from the tip, as shown in FIG. 3. In this way excess ink is prevented from accumulating at the writing tip when the tip is lifted from the surface being written on, but as soon as the tip is applied against the surface again ink is supplied to the tip to avoid any risk of ink starvation at the tip. By restricting the drawing back of ink to the end part of the forward displacement of the feed member there is avoided any risk of air being sucked into the pen and interfering with the smooth operation of the ink supply system.

It will be appreciated that the level of suction obtained in the subchamber 20 after the valve has closed will depend on the shape of the bellows and the forward movement of the feed member after valve closure, and by selecting the bellows profile and clearances the suction affect can be adjusted.

Figure 4:
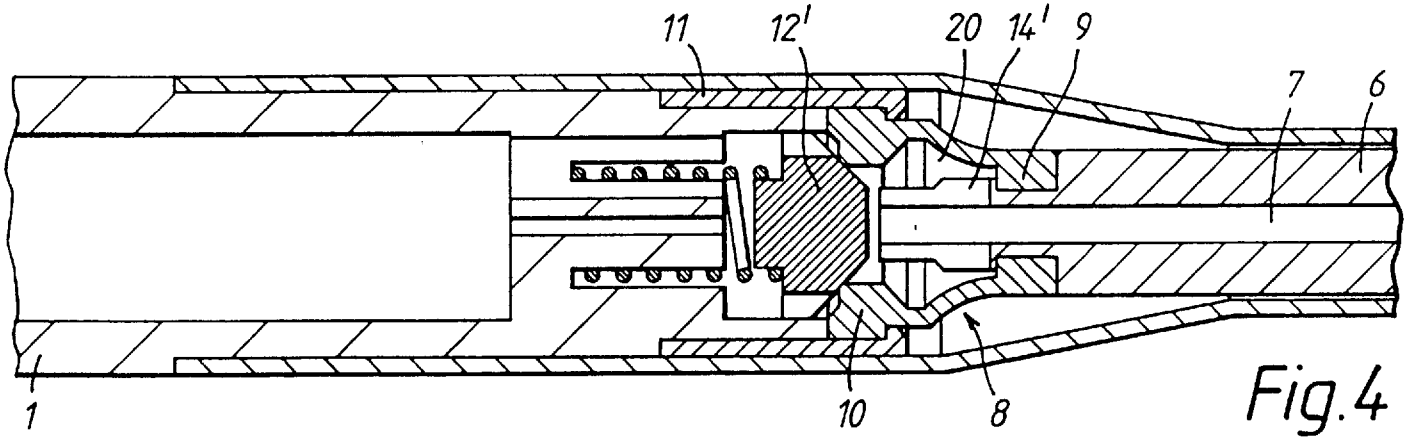
FIG. 4 is a view similar to FIG. 1 showing a modified construction.

Modifications to the construction of the reservoir pen described above are of course possible without departing from the scope of the claims which follow, and an embodiment incorporating some such modification is illustrated in FIG. 4. Instead of a ball, it has a valve member 12' with a frustoconical surface arranged to cooperate with the valve seat, whereby a larger valve opening is obtained for a given displacement of the valve member, which may be desirable if a viscous ink is being used. The valve member 12' is slidably guided in the pen body 1 by several, e.g. eight radial projections spaced apart around the valve member. Rather than discrete ports 14 connecting the subchamber 20 with the ink supply channel 7, this communication is established through a pair of diametrically opposed slots 14' which extend longitudinally from the rear end of the feed member 6. The extended ports defined by these slots may provide improved ink flow characteristics. In order to provide a more positive location of the forward collar 9 of the diaphragm member 8, the feed member is provided with a circumferential groove in which the collar is seated. Other modifications will occur to those skilled in the art.

We claim:

1. A marking instrument comprising a reservoir chamber for holding a supply of marking fluid, a marking tip for applying the marking fluid to a surface, a supply channel for conducting fluid to the tip, normally closed valve means controlling communication between the reservoir chamber and the supply channel, the marking tip being retractable to open the valve means by applying the tip against the surface, wherein means, separate from the valve means, are provided to draw fluid through the supply channel from the tip during forward movement of the tip away from the valve means after the valve means has closed.

2. A marking instrument according to claim 1, wherein the valve means includes a subchamber of variable volume which is connected to the supply channel, the volume of the chamber being arranged to increase during forward displacement of the tip away from the valve means after the valve means has closed.

3. A marking instrument according to claim 2, wherein the subchamber is partially confined by a resiliently deformable member which acts to urge the tip forwardly away from the valve means.

4. A marking instrument according to claim 3, wherein the resiliently deformable member defines a seat of the valve means.

5. A marking instrument according to claim 3, wherein the supply channel is formed in a feed member axially slidable in a barrel of the instrument, and the resiliently deformable member is annular and sealingly connected between the feed member and the barrel.

6. A marking instrument according to claim 5, wherein an inner end of the feed member is arranged to act on a valve member of the valve means for opening the valve means.

7. A marking instrument according to claim 2, wherein the volume of the subchamber diminishes during retraction of the tip after the valve means has opened for pressurizing the contents of the reservoir chamber for delivery of fluid to the tip from the reservoir chamber.

8. A marking instrument comprising a barrel enclosing a reservoir chamber for holding a supply of marking fluid, a feed member axially slidable relative to the barrel and carrying a marking tip at a forward end thereof, a supply channel extending through the feed member for conducting fluid to the tip, an annular resiliently deformable member sealingly connected between the feed member and the barrel and confining a subchamber communicating with the supply channel, and a-normally closed valve means, separate from the deformable member, controlling communication between the reservoir chamber and the subchamber, the marking tip being retractable to open the valve means by applying the tip against a surface.

* * * * *